United States Patent [19]

Clauss

[11] Patent Number: 4,615,371

[45] Date of Patent: Oct. 7, 1986

[54] AWNING WITH RESILIENT MOTOR COUPLING

[75] Inventor: Ulrich Clauss, Bissingen, Fed. Rep. of Germany

[73] Assignee: Clauss Markisen, Bissingen-Ochsenwang, Fed. Rep. of Germany

[21] Appl. No.: 651,303

[22] Filed: Sep. 17, 1984

[30] Foreign Application Priority Data

Sep. 23, 1983 [DE] Fed. Rep. of Germany ..... 3334416

[51] Int. Cl.[4] ..... E04F 10/06

[52] U.S. Cl. ..... 160/22; 160/70; 160/310; 160/322

[58] Field of Search ..... 160/66–75, 160/22, 310, 311, 315, 322

[56] References Cited

U.S. PATENT DOCUMENTS

| | | | |
|---|---|---|---|
| 2,254,566 | 9/1941 | Cornell | 403/229 X |
| 2,962,647 | 11/1960 | Borenstein | 160/66 X |
| 3,285,089 | 11/1966 | Tsugawa | 160/310 X |
| 3,285,325 | 11/1966 | Easton | 160/310 |
| 3,847,171 | 11/1974 | Akers et al. | 160/310 X |
| 3,991,805 | 11/1976 | Clauss | 160/68 X |
| 4,172,563 | 10/1979 | Werner et al. | 160/310 X |
| 4,342,354 | 8/1982 | Leivenzon et al. | 160/310 X |
| 4,372,367 | 2/1983 | Baldanello et al. | 160/310 |
| 4,411,348 | 10/1983 | Fillion | 160/310 X |
| 4,417,185 | 11/1983 | Bullat | 160/310 X |

*Primary Examiner*—Ramon S. Britts
*Assistant Examiner*—David M. Purol
*Attorney, Agent, or Firm*—Collard, Roe & Galgano

[57] ABSTRACT

A motorized awning is provided having a rotatably supported winding shaft housed in an awning box for an awning cloth capable of being wound on the winding shaft, the cloth being secured along one edge on the winding shaft and along the opposite edge on an extendable rod, an immovably supported drive motor, its output shaft coupled with the winding shaft for the automatic retraction of the awning by means of a resilient coupling member which permits at least a limited relative rotary motion between the winding shaft and the output shaft of the drive motor, a first limit switch for controlling the motor current when the cloth of the awning is retracted and a second limit switch for controlling the motor current when the cloth is extended, so that after the actuation of the limit switches the drive motor can be started only with the opposite sense of rotation. The limit switches are activated when the awning cloth is fully extended or retracted and the resilient coupling member has permitted the limited relative rotary motion between the winding shaft and the motor output shaft.

38 Claims, 16 Drawing Figures

AWNING WITH RESILIENT MOTOR COUPLING

The present invention relates to a coupling for a motorized awning. More particularly, the present invention relates to a coupling for an awning motor wherein the winding shaft is rotatably supported and arranged in a box accommodating the awning which is capable of being wound on said winding shaft, the awning cloth being secured along one edge on the winding shaft and along the opposite edge on an extendable rod, a stationary drive motor coupled through its output shaft with the winding shaft for automatically retracting the awning, limit switches driven by the winding shaft or drive motor, one limit switch controlling the motor power when the awning cloth is retracted and the other controlling the motor power when the awning cloth is extended, whereby upon actuation of said switches, the driving motor can be started only in the opposite direction of rotation.

With such well known awnings, the winding shaft is designed as a tube accommodating the relatively long drive motor. At one side disposed deep inside the winding shaft, the drive motor supports a coupling element such that the motor output shaft protruding from said one side is rotatably fixed with the winding shaft. At the opposite side, i.e., the side adjacent to the one end of the winding shaft, the limit switch is flanged on the motor. By means of the casing of said limit switch, the drive motor is rotatably fixed with the box or end piece of the box of the awning.

One or two threaded spindles are rotatably supported in the casing of the limit switch, with actuating elements for two sets of switches secured on said spindles. Said threaded spindles are driveably coupled by means of gears with a tube supporting a corresponding inside toothing. Said tube extends between the drive motor and the winding shaft up to the inside face side of the drive motor, where it is rotatably fixed with the output shaft of the motor. In this manner, when the motor is switched on for retracting or extending the awning, in addition to causing the winding shaft to rotate, the threaded spindles disposed in the limit switch casing are also jointly driven, with the switching elements reciprocating on said spindles accordingly. As soon as the final position has been reached in each case, the flow of current corresponding with the direction of rotation is interrupted by the corresponding set of switches, and the winding shaft is stopped. Restarting is then possible only in the reverse direction of rotation.

It has been found in practice that this structure or design of the awning with a limit switch driveably coupled with the output shaft of the drive motor or winding shaft is extremely useful in the installation of awnings since no additional external wiring between separate limit switches and the motor is required due to the fact that the limit switch and the motor are a single assembly, which, as such, is completely wired.

However, it has been found to be a drawback that the motor, after the awning has been in operation for a long period of time, is stopped by the limit switch before the awning is completely retracted, even in cases where the position of the corresponding limit switch had been perfectly adjusted after installation. The cause of this lies in the lengthwise change of the cloth of the awning which stretches during the course of time, so that it is no longer completely retracted in the awning box after the winding shaft has been rotated by the predetermined number of revolutions.

Such incomplete retraction of the awning is not only visually unattractive, but also results in greater soiling of the awning cloth at the non-retracted area of the cloth.

It is, therefore, an object of the present invention to improve an awning of the type described above in such a way that the awning cloth can be completely retracted in a reliable manner without any change in the adjustment of the limit switches even after a period of extended use.

According to the present invention, this object is accomplished by providing an awning as described above, wherein the motor coupling between the motor output shaft and the winding shaft of the awning is resilient. The resilient coupling between the output shaft of the drive motor and the winding shaft permits an adjustment of the limit switch within a relatively wide range of tolerance to the extent that the drive motor does not need to be shut off as soon as the extendable rod rests against the slot provided for the cloth in the awning box. If the resilient coupling permits a relative rotary motion between the output shaft and the shaft of the cloth of about 180°, the limit switch may be set after installation in such a way that the motor is stopped once the relative rotation has reached about half of the total possible rotation, i.e., 90°. Now, if the awning cloth stretches over the course of time, said increase in length is accommodated by the resilient coupling until the increase in length equals a one fourth part of the circumference of the baled or wound cloth, without any twisting occurring in the coupling.

Furthermore, the resilient coupling also solves problems generated by other influences that otherwise may lead to overloading of the motor due to the fact that the extendable rod prematurely strikes the cloth slot of the awning box. This may occur if the cloth of the awning is swelled due to humidity in the air whereby the diameter of the winding per revolution is increased, with the result that the cloth is completely wound even before the shaft of the motor has completed the number of rotations which the limit switch has to take into account. In the present case, no overloading of the drive motor occurs because the difference in length is accommodated by the resilient coupling.

Basically, the resilient coupling of the present invention may be designed in two ways. The coupling may be a spring elastic means which positively couples the motor output shaft with the winding shaft at least in the direction of rotation corresponding to the winding of the cloth; or the coupling may be in the form of a friction clutch, in which case, however, a timing device is connected between the limit switch, which in this case is directly actuated by the winding shaft, and the drive motor. The timing device permits the drive motor to continue running for a predetermined period of time after the limit switch has been actuated, namely, in the sense of further winding of the cloth. The latter design, in spite of its slightly higher cost in terms of the switch, nevertheless has the advantage that practically unlimited variations in length can be taken into account. Moreover, the coupling tube between the drive for the limit switch and the output shaft of the drive motor can be omitted because the limit switch can be driven directly by a gear accommodated in the winding shaft and disposed within the zone of the corresponding side of the winding shaft. However, even the coupling with the spring elastic design may be used in association with a timing device, in which case it is possible to omit the transmission coupling between the output shaft of the drive motor and the limit switch unit.

Depending on the design of the spring coupling, it may be that no torque with an opposite sense of rotation is transmitted via the coupling. For this reason, the coupling is provided with a form-locking stop means, by means of which an effective positive connection is established between the winding shaft and motor output shaft in the sense of rotation corresponding with the unwinding of the cloth. Obviously, this positive connection may also be used with the friction clutch design for the coupling.

A very simple installation of the coupling is achieved if the coupling is positively connected with the winding shaft and motor output shaft on its output and input sides, respectively. If, in this connection, the winding shaft is designed in the form of a tube with an inwardly projecting radial beading extending along the length of the winding shaft, with at least the coupling being accommodated in the interior of the shaft, the output side of the coupling may be positively engaged with said beading.

A coupling of very simple design is comprised of a hub forming the input side, and a driver or cam rotatable on and axially fixed with respect to said hub and having a recess on the peripheral edge thereof, with a spring elastic member transmittingly arranged between said hub and said driver. The recess, which is on the peripheral edge of the driver, may engage the beading in the winding shaft.

Said spring elastic or resilient member may be formed by a leaf spring wound several times around the hub. The one end of the leaf spring being anchored on the hub and the other end on the driver in a way resembling the fitting of the winding spring of a clock. In order to protect the spring against external damage, the drivers of the coupling are formed as two identical circular disks arranged with a space therebetween, the disks are rigidly connected with each other and rotatable on the hub and accommodating the spring member between them. It is possible also to provide the spring elastic member in the form of a helical spring anchored at one end on the hub and at its other end on the driver, which is rotatably supported on the hub. In this case, the helical spring may selectively coaxially surround the hub, or it may extend in the circumferential direction of the hub, arching with its axis around the circumferential surface of the hub.

The afore-mentioned, positive locking stop means may be realized in a very simple way by connecting a segmented disk with the hub for fixed rotation therewith and extending parallel to the driver rotatably supported on the hub, with the sector angle of the disk being the complementary angle supplementing the angle corresponding to 360° of rotary motion. The segmented disk engages the beading of the winding shaft when the hub is rotated relative to the drive accordingly.

If torques are to be transmitted in both directions via the spring elastic member of the coupling, the coupling may be formed as a torsion bar extending coaxially to the winding shaft. In this case, one end of the torsion bar may support a coupling arrangement for receiving the motor output shaft and its other end may support the driver, which is supported thereon for fixed rotation therewith and coupled with the winding shaft. Also in this case, the driver is provided with a recess on its peripheral edge, by means of which the winding shaft is coupled with the driver.

In order to provide the coupling having the torsion bar with the afore-mentioned positive locking stop means, the end of the torsion bar coupled with the motor output shaft, in the simplest case, supports a segmented disk secured thereon for fixed rotation, the disk being dimensioned as described above.

In any case, installation of the arrangement is very simple since the coupling need only be pushed into the winding shaft so that a positive coupling with the winding shaft is achieved with the help of the recess in the driver without requiring any additional fastening means.

If a friction engaging connection is provided between the motor output shaft and the winding shaft, the coupling, in the simplest case, is comprised of two sets of alternately arranged friction plates pressed against each other by means of a spring, of which one set is rotatably fixed on the hub for axial displacement, the hub being coupled with the motor output shaft, and the other set is rotatably fixed on the winding shaft. This design is made very simple if the friction plates coupled with the winding shaft are provided with a peripheral recess for receiving the beading of the winding shaft, said plates are then installed in the winding shaft in such a way that the beading and the recess are engaged.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
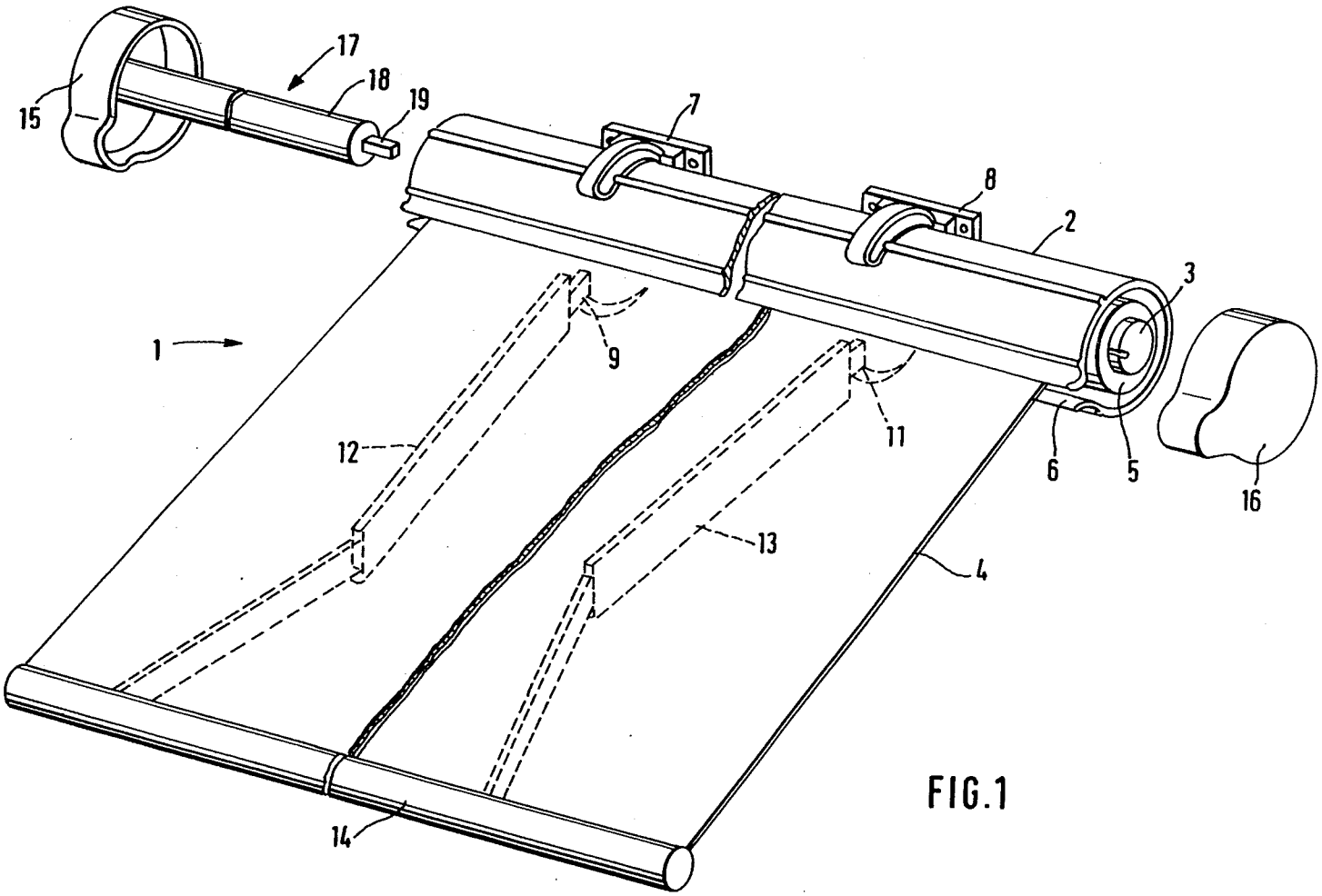
FIG. 1 is an exploded perspective view of an awning according to the present invention.

Now turning to the drawings, there is shown in FIG. 1 an articulated-arm awning 1 having a tubular winding shaft 3 rotatably supported in an awning box 2, an awning cloth 4 secured on shaft 3 and partially wound thereon, forming a bale 5. Awning box 2 is comprised of a tubular piece cut to length from an extruded tubing section or extruded aluminum tubing having a slot 6 extending along its entire length serving as the passageway for extending awning cloth 4. Awning box 2 is secured by wall fasteners 7 and 8 anchored in the wall (not shown in the drawing) of a building. Said fasteners surround the awning box in the form of a 'C' and, at the same time, support joints 9 and 11 of the articulated arms 12 and 13, said joints being disposed on the wall side. An extendable rod 14 having a circular cross section is pivotally mounted on the front ends of the two articulated arms 12 and 13 in a manner known per se, with awning cloth 4 being secured on said rod.

On its sides, awning box 2 is provided with two caps 15 and 16, of which cap 16, in a manner known per se, supports a bearing for tubular shaft 3, which, due to the way in which the assembly is shown in FIG. 1, is not visible in detail. Cap 15, on the other hand, supports drive motor 17 which, in the mounted condition, is accommodated in winding shaft 3. The cylindrical casing 18 of motor 17 is provided with a slender shape in order to fit in winding shaft 3. A square output shaft 19 projects from the side of casing 18 of motor 17 disposed inside shaft 3. The output shaft is coupled with winding shaft 3 by means of a coupling 20 (FIG. 2) specified in detail in the following.

Figure 2:
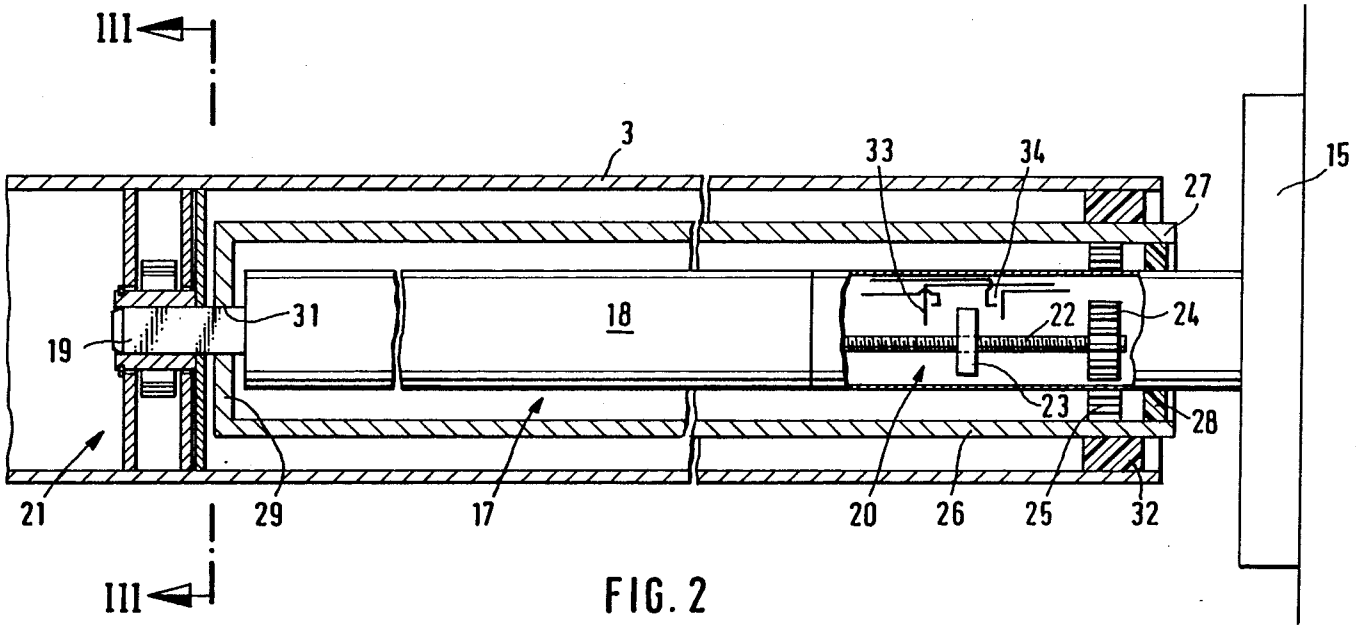
FIG. 2 is a cross sectional view of the winding shaft of the awning according to FIG. 1, with the drive motor arranged therein as well as the associated resilient coupling.

FIG. 2 shows a detailed sectional view of the arrangement of drive motor 17 as well as of coupling 20. Accordingly, at its end shown in FIG. 2 on the left side, casing 18 of drive motor 17 has a gearing provided in a manner known per se; the output shaft of this gearing is the external four-cornered shaft 19. The electric motor is disposed within the central zone of casing 18, whereas a limit switch device 21 is provided in the right-hand section of the casing, which is shown broken away. Limit switch device 20 is comprised of a threaded spindle 22 supported in casing 18 and extending lengthwise, and an actuating element 23 threadably mounted on said spindle, said actuating element being supported in a longitudinal guide (not shown in detail in FIG. 2) parallel to threaded spindle 22 in such a way that it is displaceable lengthwise, but secured against rotation. For actuating threaded spindle 22, a spur gear 24 is fixed rotatably on spindle 22, said spur gear projecting with a part of its circumferential area from an opening correspondingly provided on the circumferential side of casing 18, where it engages with an internal gear 25. Gear 25 is mounted in a tubular coupling piece 26, which, with its end 27 disposed within the range of the end of winding shaft 3, is rotatably supported on the cylindrical outside surface of casing 18 by means of plastic bushing 28.

The tubular coupling piece 26 extends coaxially between winding shaft 3 and casing 18 of drive motor 17, namely, as shown in FIG. 2, up to the end of casing 18 of drive motor 17, where it is terminated by a plate 29 connected in one piece with tubular coupling piece 26. End plate 29 is provided with a square opening 31 arranged coaxially with respect to tubular coupling piece 26 or axis of winding shaft 3, with the four-cornered or square drive shaft 19 extending through said opening in a close fit manner.

Winding shaft 3 itself is rotatably supported on tubular coupling piece 26 by means of an inserted plastic bushing 32, permitting a relative rotary motion between tubular coupling piece 26 and winding shaft 3.

Actuating element 23 threadably mounted on spindle 22 serves to actuate two adjustable single-pole switch contacts 33 and 34, by means of which current is supplied to drive motor 17 in a known manner. Switch 33 is connected in the power circuit which permits the starting of drive motor 17 in the sense of rotation by which awning cloth 4 is wound, whereas switch 34 is connected in the power circuit by means of which drive motor 17 is started with the sense of rotation by which cloth 4 of the awning is unwound or extended from the awning box. The wiring required for this operation as well as the external switches required by the operator for controlling the operation of the awning are known and, for this reason, not shown in any greater detail. In this way, the limit switches are actuated dependent on the number of revolutions of output shaft 19.

The mode of operation of the awning as specified above is described as follows:

When motor power is switched on by means of switch 33 by throwing the external operating switch (not shown), output shaft 19 of drive motor 17 starts to rotate in the sense of rotation winding awning cloth 4. The torque generated by output shaft 19 is transmitted to rotatably supported winding shaft 3 by means of resilient coupling 21. Cloth 4 of the awning is thus retracted by said winding shaft through slot 6, namely against the force applied to cloth 4 by articulated arms 12 and 13 via extendable rod 14, said force acting in the sense of pulling said cloth from slot 6. By said rotary motion of output shaft 19, coupling tube 26, which is fixedly connected with output shaft 19, is simultaneously rotated and thus also gear 25, which is fixedly connected with coupling tube 26. Gear 25 in turn drives spur gear 24, with which it is engaged, so that the threaded spindle rotates together with coupling tube 26 with the corresponding transmission ratio. As a result of the rotation of threaded spindle 22, actuating element 23, which is prevented from rotating, is gradually moved to the left, i.e., in the direction of switch 33, which is adjusted in such a way that it is opened after winding shaft 3 has been rotated by about one additional quarter turn after extendable rod 14 has come to rest against the mouth of slot 6, thereby interrupting the motor current in the sense of any further winding of awning cloth 4.

The relative rotary motion required for this purpose between winding shaft 3 and output shaft 19 of drive motor 17 is accommodated or absorbed by resilient coupling 21, which is transmittingly arranged between output shaft 19 and winding shaft 3.

Figure 3:
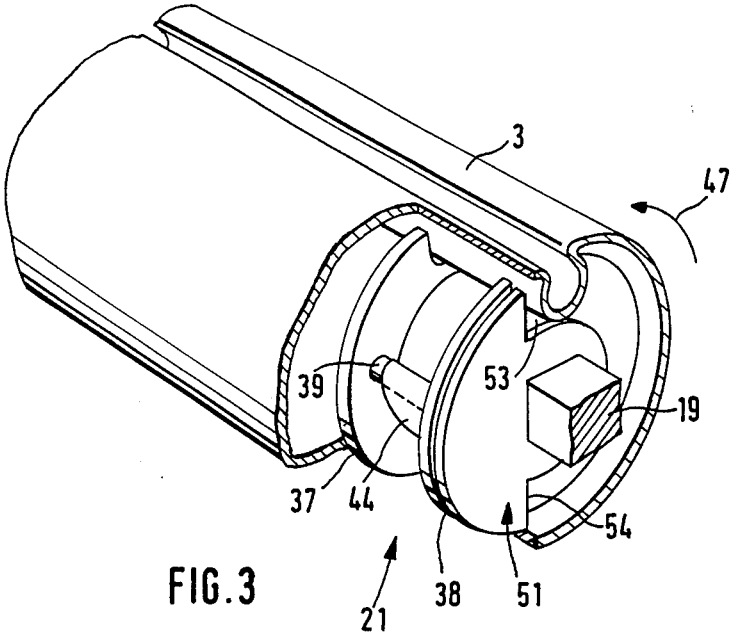
FIG. 3 is a cross sectional view in perspective of the winding shaft according to FIG. 2 taken along line III—III of FIG. 2 with the wall partially broken away.
Figure 4:
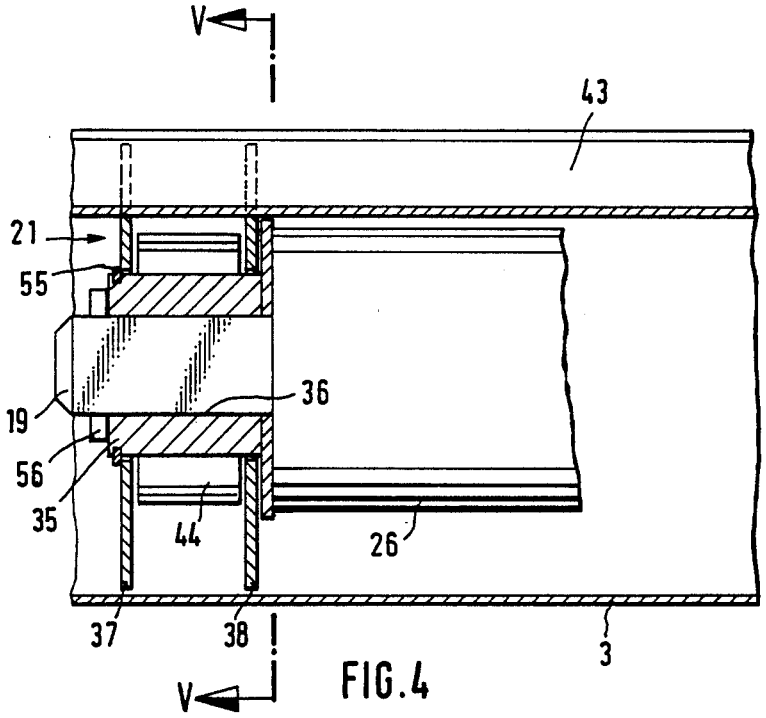
FIG. 4 is an axial cross sectional view of the winding shaft of FIG. 3.
Figure 5:
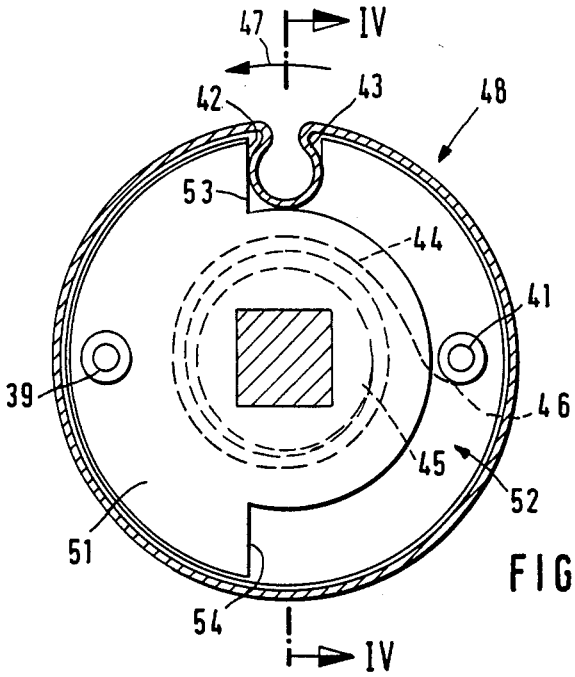
FIG. 5 is a cross sectional view of the winding shaft according to FIG. 4 taken along line V—V of FIG. 4, with a top view of the coupling element.

As clearly seen in FIGS. 3 to 5, resilient coupling 20 is comprised of a cylindrical hub 35 with a coaxial square opening 36, by means of which hub 35 can be mounted on output shaft 19 of drive motor 17. Two circular disks, 37 and 38, are rotatably mounted on hub 35, but fixed thereon in the axial direction. Each of said disks is provided with a correspondingly concentric opening, by means of which they are mounted on hub 35. Said disks 37 and 38 are parallel to each other with a space therebetween and are rigidly connected together by two rivets 39 and 41 which are diametrically oppositely positioned with respect to square opening 36. Disks 37 and 38 form the output side of resilient coupling 20 and are intended to be drivers, for which purpose each is provided with a recess 42 on its peripheral edge. Said recesses are aligned with each other, engaging a beading 43 projecting inwardly from winding shaft 3 as shown in FIGS. 3 and 5. Between disks 37 and 38, there is disposed a leaf spring 44 wound in the manner of a watch spring which is rotatably rigidly anchored at its inside end 45 on hub 35, and secured at its outside end 46 at rivet 41.

Since, with such a leaf spring 44, torque can be transmitted only in one direction of rotation, namely in the direction of rotation indicated by arrow 47, which corresponds with the direction of winding of leaf spring 44 shown in FIG. 5, resilient coupling 20 is provided with a form-locking stop means 48. Form-locking stop means 48 is comprised of a segmented disk 51, which is fixed rotatably on the side of hub 35 facing drive motor 17, for example by spot welding. Segmented disk 51 has the shape illustrated in FIGS. 3 and 5 with a recess 52 extending across a sector angle greater than 180°. Said recess has a depth dimensioned in such a way that segmented disk 51 is capable of freely revolving beneath beading 43 of winding shaft 3 until one of the end surfaces 53 or 54 defining the limits of recess 52 in the circumferential direction comes to rest against beading 43. Preferably, the sector angle is at least greater than 90 degrees.

Drive disks 37 and 38 are axially secured on hub 35, namely at the one end by means of segmented disk 51 secured on hub 35, and at the other end by means of a snap ring 55 fitted in a corresponding slot in hub 35. Hub 35 is axially secured on output shaft 19 by means of a spring sleeve 56 seated in a corresponding transverse bore at the free end of output shaft 19, so that hub 35 is fixed between the spring sleeve 56 and end plate 29 of tubular coupling piece 26.

When awning 1 is installed, after the tubular coupling piece 26 has been pushed over drive motor 17 as shown in FIG. 2, resilient coupling 20 is connected by fitting its hub 35 on square output shaft 19, and secured by means of spring sleeve 56. Subsequently, with the sense of winding of leaf spring 44 shown in the drawing, the two interconnected disks 37 and 38 of the resilient coupling are turned contra to the direction indicated by arrow 47 in order to initially stress spring 44 while hub 35 is retained. As soon as spring 44 has been sufficiently prestressed, drive motor 17 is installed in winding shaft 3, with resilient coupling 20 being inserted first, whereby recesses 42 of disks 37 and 38 engage inwardly projecting beading 43 of winding shaft 3. As shown in the figures, said beading 43 may be hollow and serve to fasten the inside edge of awning cloth 4. Now, as long as no external forces act on the arrangement, the initial tension in spring 44 causes contact surface 53 of segmented disk 51 to be biased against beading 43. This initial tension is such that the position shown in FIGS. 3 and 5 is maintained even if awning cloth 4 is pulled from slot 6 by the force of articulated arms 12 and 13 and by the force of gravity acting on extendable rod 14, which (based on FIG. 5) would rotate winding shaft 3 against the force of the initial tension of spring 44, i.e., opposite to the direction of arrow 47. The initial tension of spring 44, however, prevents winding shaft 3 from rotating relative to segmented disk 51, which is rigidly coupled with output shaft 19, and to detach itself from the contact or stop surface 53.

If drive motor 17 is now started for retracting cloth 4 of the awning in the way as specified above, output shaft 19 rotates in the direction indicated by arrow 47, i.e., counterclockwise, causing the cloth to be wound in the form of baling 5 on winding shaft 3. During this operation, the relative position between segmented disk 51 and winding shaft 3 shown in FIGS. 3 and 5 is maintained until extendable rod 14 comes to rest at the mouth of slot 6. At this point, winding shaft 3 is arrested by means of cloth 4 and thus prevented from further rotation, whereas output shaft 19 of drive motor 17 continues to revolve because the motor current has not yet been interrupted by associated switch 33. Consequently, segmented disk 51 continues to rotate relative to winding shaft 3 in the direction indicated by arrow 47, causing contact surface 53 to be released from beading 43 of winding shaft 3.

If the recess 52 of segmented disk 51 is dimensioned in such a way that segmented disk 51 is capable of rotating in winding shaft 3 by a turn of about 180°, switch 33 of limit switch unit 21 is usefully adjusted in such a way that switch 33 is opened by actuating element 23 after segmented disk 51 has completed a quarter turn with respect to winding shaft 3 after extendable rod 14 has come to rest against slot 6. As soon as segmented disk 51 has reached this position, the motor current is interrupted by switch 33 and output shaft 9 is stopped immediately. Since the gearing of drive motor 17 is self-locking, extendable rod 14 is always kept under tension when resting against slot 6. Thus, the flow of force takes place by means of cloth 4, winding shaft 3, beading 43, disks 37 and 38, which are coupled form-locked with beading 43, leaf spring 44 to hub 35, and from there to locked output shaft 19. Because of open switch 33, drive motor 17 cannot be restarted for further winding of awning cloth 4. Drive motor 17 can be switched on again only in the opposite direction, i.e., in the sense of direction unwinding the cloth, because switch 34 is closed. When this power circuit is switched on, output shaft 19 rotates contra to the direction of arrow 47, whereby winding shaft 3 is arrested until segmented disk 51 comes to rest against beading 43 with contact surface 53. Since the rotary motion of output shaft 19 continues, winding shaft 3 is also caused to rotate in the direction opposing that indicated by arrow 47, namely by way of the form-locked coupling between contact surface 53 of segmented disk 51 and beading 43. The rotations of winding shaft 3 take place only after segmented disk 51 of resilient coupling 20 has again assumed its position relative to winding shaft 3, which relative position is shown in FIGS. 3, 4 and 5. The sector angle of the segmented disk is obviously the complementary angle supplementing the relative rotary motion between winding shaft 3 and output shaft 19 to 360 degrees.

In the course of the motion extending awning 1, actuating element 23 travels along revolving threaded spindle 22 from switch 33 in the direction of switch 34, which, if the circuit is switched on by the operating person, opens once awning 1 has been completely extended. For this purpose, switch 34 is set accordingly.

During the entire time of cloth-extending motion, a form-locked coupling is established between winding shaft 3 by means of segmented disk 51 up to output shaft 19 of drive motor 17.

It can be readily seen that resilient coupling 20 is capable of length compensation when cloth 4 of the awning is wound on winding shaft 3. Assuming that said cloth 4 has been stretched in the course of time by less than one fourth part of the circumference of the wound cloth or baling, the relative rotation between output shaft 19, i.e., between hub 35 of resilient coupling 20 and winding shaft 3 is correspondingly reduced, i.e., segmented disk 51 moves a shorter distance from the basic position shown in FIG. 5, i.e., from the position in which contact surface 53 rests against beading 43.

If, however, cloth 4 of the awning is swelled due to high air humidity, causing the baling 5 to have an increased diameter, extendable rod 14 will come to rest against the mouth of slot 6 with a fewer number of revolutions of winding shaft 3, i.e., winding shaft 3 comes to a stop at a point before the point reached under normal conditions, whereby the exemplified embodiment specified here will again permit a lengthwise compensation up to a quarter circumference of the winding. In this case, the relative rotation between output shaft 19 and winding shaft 3 and thus also between segmented disk 51 and beading 43 will be relatively greater.

If more extensive relative motions between output shaft 19 and winding shaft 3 are desired, recess 52 of segmented disk 51 has to extend over a larger sector angle than the one shown. In any case, unwinding is achieved by the form-locked coupling from output shaft 19 via segmented disk 51 up to beading 43 of winding shaft 3, whereas during the winding of the cloth, a form-closed coupling is achieved from the winding shaft via spring 44 up to output shaft 19, whereby spring 44 is prestressed to a degree such that no relative rotations can be caused between segmented disk 51 on the one side and disks 37 and 38 or winding shaft 3 on the other as long as extendable rod 14 does not rest against the mouth of slot 6.

Figure 7:
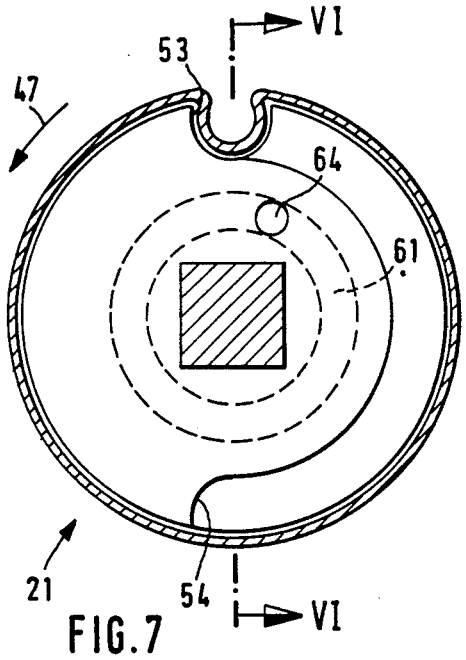
FIG. 7 is a cross sectional view of the winding shaft according to FIG. 6 taken along line VII—VII of FIG. 6.
Figure 6:
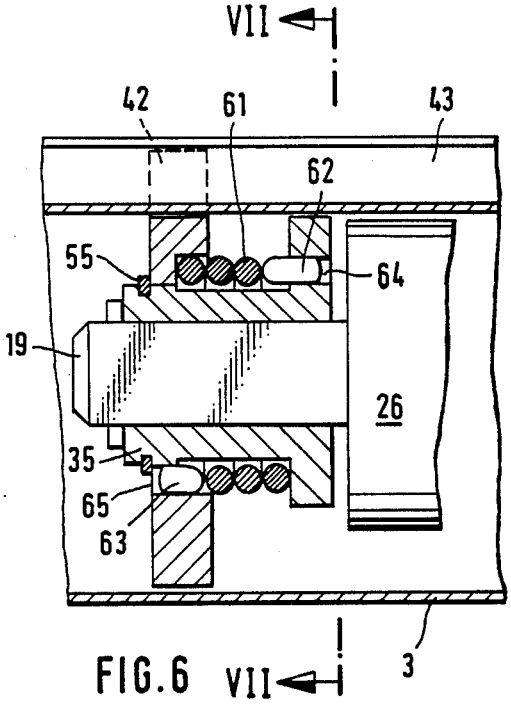
FIG. 6 is a cross sectional view of the winding shaft similar to FIG. 4, with a coupling having a coaxial helical spring taken along line VI—VI of FIG. 7.

FIGS. 6 and 7 show another embodiment of a resilient coupling 20. The basic difference between the latter and the embodiment described above is that an elastic spring member is used in the form of a cylindrical coil spring 61 instead of leaf spring 44. In all other respects, identical components are identified by the same reference numerals as in the preceding embodiment, so that such components are not specified again.

Resilient coupling 20 according to FIGS. 6 and 7 is again provided with a hub 35 forming one piece with segmented disk 51 of stop means 48. The shape of segmented disk 51 is identical with the shape specified in connection with FIGS. 3, 4 and 5.

Only one circular drive disk 37 is rotatably supported on the cylindrical part of hub 35. As in the preceding embodiment, disk 37 engages beading 43 of winding shaft 3 with its recess 42, which is formed on the peripheral edge thereof. For transmittingly coupling hub 35 and drive disk 37, a helical spring 61 is provided between segmented disk 51 and drive disk 37, said spring surrounding hub 35 or square output shaft 19 coaxially with the necessary clearance. Both ends 62 and 63 of helical spring 61 are bevelled parallel to the axis of output shaft 19 and inserted in corresponding axial bores 64 and 65, respectively, of segmented disk 51 and drive disk 37.

In the axial direction, drive disk 37 is secured in the direction of segmented disk 51 by helical spring 61, and in the opposite direction by a snap ring 55 inserted in a corresponding slot in hub 35, said snap ring being disposed opposite helical spring 61 with respect to drive disk 37.

As with the preceding embodiment, the installation is carried out with helical spring 61 in a prestressed state, resulting in the resting position shown in FIG. 7, in which contact surface 53 of disk 51 rests against beading 43.

When cloth 4 of the awning is wound, the force is transmitted from output shaft 19 to hub 35 and from the hub to segmented disk 51, which is formed in one piece with the hub, and from there, the force is transmitted to drive disk 37 via helical spring 61. Drive disk 37 drives winding shaft 3. As soon as the extendable rod 14 comes to rest against the mouth of slot 6, winding shaft 3 comes to a stop and output shaft 19, which continues to rotate, winds helical spring 61 in the direction indicated by arrow 47 until the flow of current to motor 17 is interrupted by switch 33.

During unwinding, however, a form-locked connection exists between contact surface 53 and beading 43, so that winding shaft 3 is positively caused to rotate by output shaft 19. In all other respects, the mode of operation and cooperation is the same as specified in the earlier part.

Figure 8:
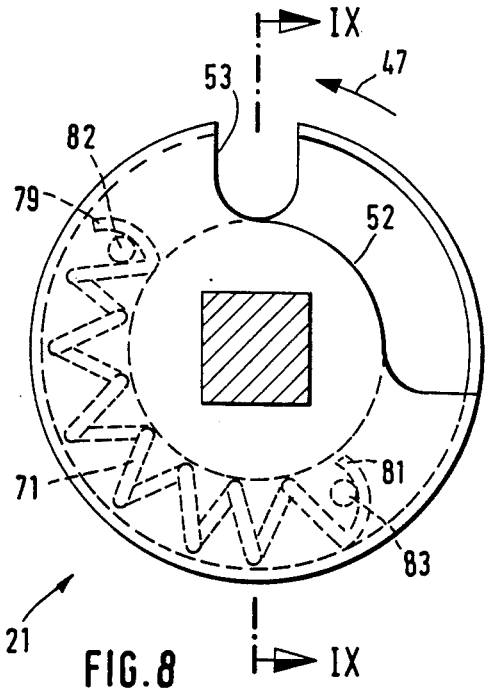
FIGS. 8 to 10 show ther embodiment of a resilient coupling for the awning according to FIG. 1, with the helical spring shown extending around the hub in the two lateral views of FIGS. 8 and 10 and a view in FIG. 9 taken along line IX—IX of FIG. 8.
Figure 9:
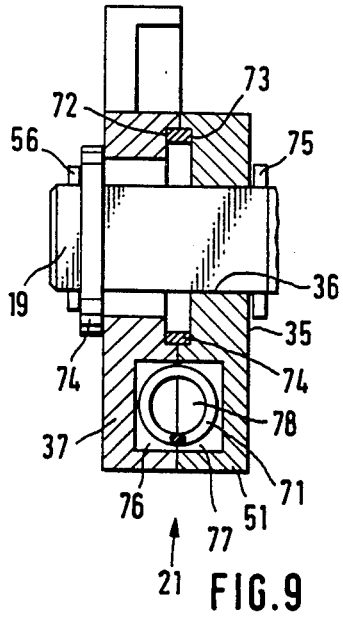
Figure 10:
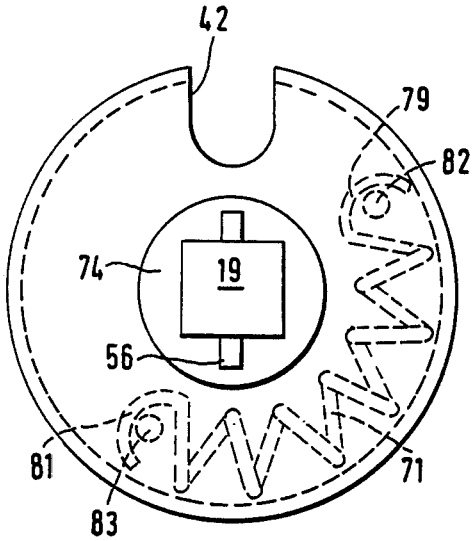

In the exemplified embodiment of resilient coupling 20 shown in FIGS. 8 to 10, a tension spring 71 is used, which, with its longitudinal axis, is coiled around output shaft 19 in the circumferential direction and does not extend coaxially with output shaft 19 as does coil spring 61.

Segmented disk 51, which again is provided with a recess 52 formed on the peripheral edge thereof, is shaped on hub 35, forming one piece with said hub. With a correspondingly shaped square opening 36, hub 35 is coupled in a form-locked way with square output shaft 19, whereas circular drive disk 37 rests flat on segmented disk 51, as clearly shown in FIG. 9. In order to prevent drive disk 37 from migrating radially with respect to segmented disk 51, both segmented disk 51 and drive disk 37 are provided on their facing surfaces with recesses 72 and 73, in which a ring-shaped sleeve 74 is inserted, said sleeve radially fixing the two disks with respect to each other. Said two disks 37 and 51 are kept together by a disk 74' seated on output shaft 19, said disk 74' being axially secured by a clamping pin or spring sleeve 56 seated in a corresponding crosswise bore of output shaft 19, whereas another clamping pin 75 inserted in said output shaft 19 prevents axial migration or movement on the side of segmented disk 51 facing in the opposite direction.

The two facing flat surfaces of drive disk 37 and segmented disk 51 each contain another recess 76 and 77 disposed radially outwardly compared to recesses 72 and 73. Recesses 76 and 77 mate with each other and form a hollow space with an approximately square cross section, said space surrounding output shaft 19 circularly and concentrically. Tension spring 71 is arranged in the endless hollow space 78 formed by recesses 76 and 77. At its ends, spring 71 is provided with eyes 79 and 81, which are hooked to corresponding pins 82 and 83. Pins 82 and 83 are disposed in the hollow space 78; pin 82 being fitted axially on drive disk 37 and pin 83 axially on segmented disk 51, in each case in said hollow space 78.

If resilient coupling 20 is mounted in the winding shaft together with drive motor 17, tension spring 71 extending between pins 82 and 83 is again prestressed and will attempt to rotate segmented disk 51 against drive disk 37 contra to the direction of arrow 47. In this way, beading 43 of winding shaft 3 is clamped between recess 42 of drive disk 37 and contact surface 53 of segmented disk 51. When drive motor 17 is started in the sense of winding of cloth 4, the torque supplied by motor 17 is thus caused to be transmitted from output shaft 19 to hub 35, which is again rotatably fixed with shaft 19, and segmented disk 51 combined with hub 35 in the form of one piece, and from there to tension spring 71. From tension spring 71, the force is transmitted to pin 82 and thus to drive disk 37, which, in turn, drives the winding shaft.

As soon as the cloth of the awning is stopped before the motor current is interrupted by switch 33, a relative motion takes place between segmented disk 51, which is rotatably fixed with output shaft 19, and rotatable drive disk 37 while tension spring 71 is simultaneously stressed further.

Therefore, as with the preceding embodiment, the length of cloth 4 can be compensated for via resilient coupling 20 and switch 33 can be adjusted to a center position assuring that extendable rod 14 rests closely against the mouth of slot 6 under all operating conditions.

The torque for unwinding awning cloth 4 from winding shaft 3 is transmitted to the winding shaft by contact surface 53 of segmented disk 51.

Figure 11:
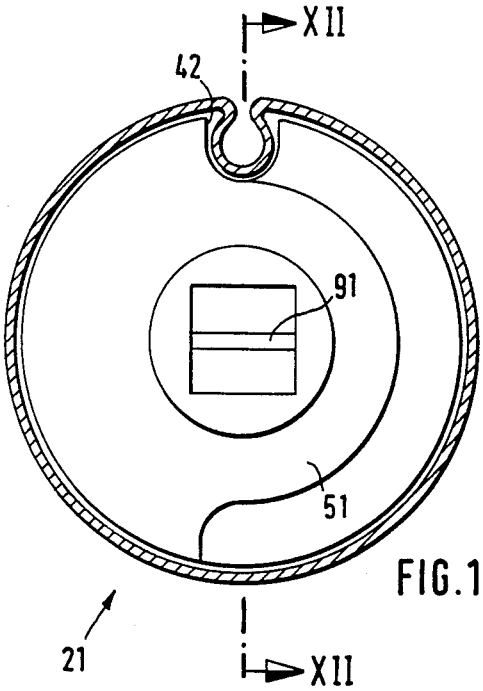
FIG. 11 is cross sectional view of the winding shaft according to FIG. 12, taken, along line XI—XI of FIG. 12.
Figure 12:
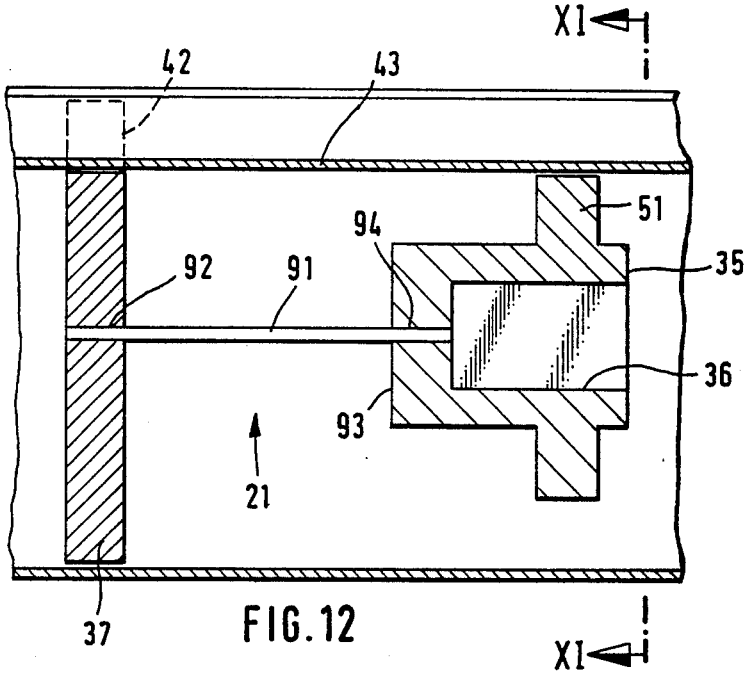
FIG. 12 is a cross sectional view of a winding shaft similar to FIG. 2 taken along line XII—XII of FIG. 11, with a resilient coupling using a torsion rod.

Resilient coupling 20 shown in FIGS. 11 and 12 is comprised of a torsion bar 91 formed as a flat rod. One end of flat rod 91 is connected in a form-locked manner to drive disk 37 by insertion in a correspondingly shaped opening 92 in the drive disk, and the other end is connected with hub 35, also in a form-locked manner. For this purpose, hub 35 is provided in this case with a square opening 36 in the form of a blind hole for receiving output shaft 19. The end of torsion bar 91 facing away from drive disk 37 is inserted in face wall 93 of hub 35 having a correspondingly shaped opening.

While with the preceding embodiments of resilient coupling 20, drive disk 37 is disposed within the direct proximity of hub 35 or rotatably supported on said hub, in the embodiment according to FIGS. 11 and 12, hub 35 and drive disk 37 are disposed with an axial spacing between each other, i.e., removed from each other by the length of torsion bar 91, which is rigidly connected therebetween. Drive disk 37 is fitted in winding shaft 3 with little clearance.

For installation, resilient coupling 20 according to FIGS. 11 and 12 is secured with hub 35 on the four-cornered or square output shaft 19 of drive motor 17 by suitable means not shown in detail in the drawing, and the arrangement so obtained comprised of resilient coupling 20 and drive motor 17 and including tubular coupling piece 26 is pushed into winding shaft 3, whereby recess 42 of drive disk 37 engages with beading 43.

Using torsion rod 91 has the advantage, as compared to the preceding embodiments, that the arrangement can be fitted without stresses, because torques can be transmitted in either sense of rotation by means of torsion bar 91, which extends coaxially with winding shaft 3 or output shaft 19, i.e., both the torque for winding and the torque for unwinding the cloth can be transmitted to winding shaft 3 by torsion bar 91. Optionally, segmented disk 51 specified earlier may be omitted in this embodiment. Furthermore, torsion bar 91 again permits a relative rotation between drive shaft 19 and winding shaft 3 in order to achieve in this way a compensation of the length between the adjustment of limit switch 33 and the actual winding length of awning cloth 4.

In addition, it is also possible in this case to combine segmented disk 51 with hub 35 in one piece as shown in FIGS. 11 and 12. The mode of operation of the segmented disk is the same as described earlier.

Figure 13:
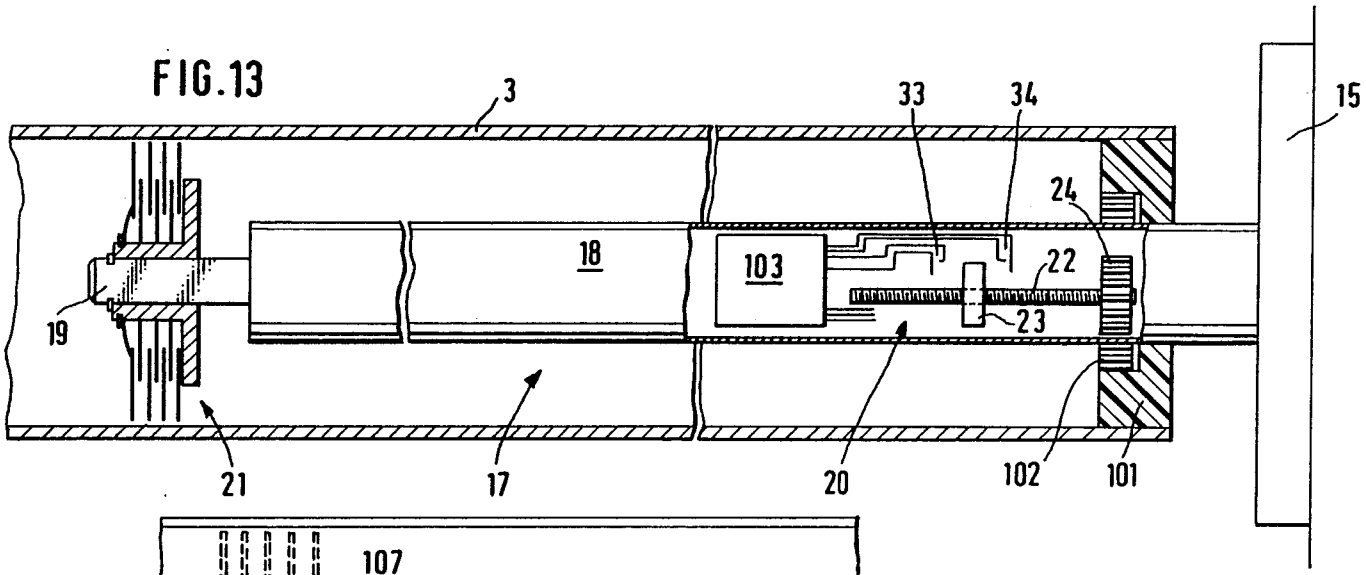
FIG. 13 is a cross sectional view of a winding shaft similar to the illustrated in FIG. 2, with a friction clutch used as the resilient coupling.
Figure 14:
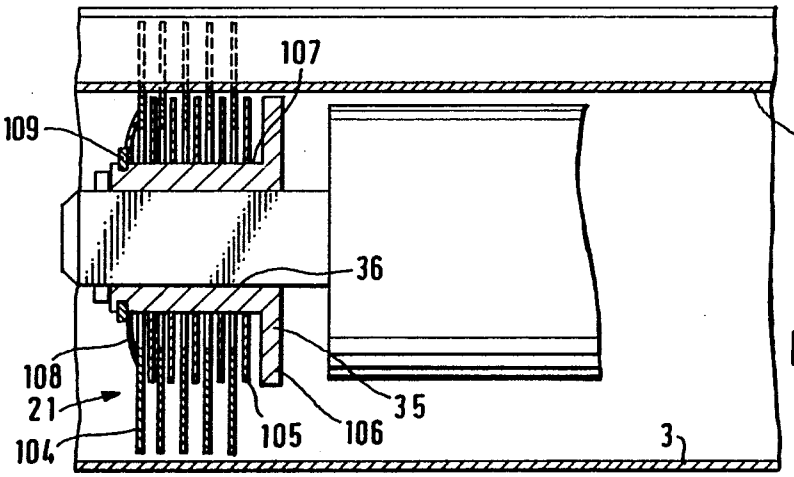
FIG. 14 is an enlarged view of the friction coupling of FIG. 13.

FIGS. 13 and 14 show a resilient coupling 20 for winding shaft 3, by way of which output shaft 19 of drive motor 17 is coupled with winding shaft 3 by friction engagement. As compared to the preceding embodiments, such a construction requires a different drive for limit switch unit 21.

With the present embodiment, winding shaft 3 has a plastic ring 101 seated in said shaft at the end adjacent to cap 15. By means of said ring, winding shaft 3 is rotatably supported at said end on cylindrical casing 18 of drive motor 17.

At the inwardly facing side of plastic ring 101, which, incidentally, is rotatably fixed with winding shaft 3, an internal gear 102 is disposed similar to internal gear 25 of FIG. 2. Said gear 102 mates with spur gear 24 of limit switch arrangement 21, which is designed as shown in FIG. 2.

A timing device 103, shown schematically in the drawing, is disposed in the power circuit of drive motor 17 connected via switch 33. This timing device is designed in such a way that on actuation of switch 33, drive motor 17 continues to receive current for a predetermined length of time and is thus permitted to continue running.

Whereas in the preceding embodiments, the number of revolutions of the output shaft of the drive motor constitutes the criterion for the actuation of switches 33 and 34, with the embodiment shown in FIGS. 13 and 14, the criterion is the number of revolutions or the position of winding shaft 3, because the latter is transmittingly connected directly with threaded spindle 22.

It is clearly seen in FIG. 14 that resilient coupling 20 is comprised of a multiple-disk friction clutch containing two sets of friction discs 104 and 105, whereby the discs 105 of the one set are rotatably fixed with hub 35 of coupling 20, whereas discs 104 of the other set engage beading 43 of winding shaft 3 in a form-locked manner. In detail, resilient coupling 20 according to FIGS. 13 and 14 is designed in such a way that the side of hub 35 disposed adjacent to drive motor 17, which, in the preceding embodiments is provided with a square passage or opening 36, is now a radially projecting flange 106 formed on said side in one piece with hub 35. The outside diameter of flange 106 is dimensioned such that said flange is capable of freely rotating beneath beading 43. The outer circumferential surface of hub 35 is provided with a toothing 107, which, in the simplest way, may be an external square. Friction discs 105 are mounted on said toothing 107, i.e., rotatably fixed on the outer circumferential surface of hub 35, however, in a way such that axial displacement thereof is permitted. Thus, one friction disc 104 is arranged in each case between each two friction discs 105 or between friction disc 105 and the plane surface of flange 106 facing away from drive motor 17.

The package of discs formed by discs 104 and 105 is compressed in the direction of flange 106 by a cup spring or spring washer 108 seated on hub 35. For this purpose, a snap ring 109 is seated behind said cup spring 108 in a groove correspondingly provided in hub 35.

The design of friction discs 104, which are freely rotatable on the outer circumferential surface of hub 35, is basically similar to that of drive disks 37 and 38, i.e., like the latter, they are provided with a recess 42 on the peripheral edge thereof, by means of which they engage beading 43 in the interior of winding shaft 3 in a form-locked way, whereas friction discs 105 have an outside diameter which permits said discs to freely rotate under beading 43.

Resilient coupling 20 is secured with its hub 35 on the four-cornered output shaft 19 of drive motor 17 in a known manner, which, for this reason, is not shown in any detail, for example by means of a spring sleeve. When so secured, all recesses 42 of friction discs 104 are aligned with one another, permitting an axial insertion of the arrangement in winding shaft 3, whereby bearing ring 101 finally disappears in the associated end of winding shaft 3, where it is connected in a form-locked way therewith, for example via beading 43, supporting said shaft 3 on casing 18 of drive motor 17.

After awning 1 has been completely assembled, limit switch 33 of limit switch unit 21 is adjusted in such a way that it is open before extendable rod 14 comes to rest against the mouth of slot 6. In said position, extendable rod 14 is disposed in front of slot 6 with a certain safety spacing from said slot.

During normal operation, when drive motor 17 is started in the sense of retracting cloth 4 of the awning, switch 33 is thrown over by actuating element 23 after a certain time has elapsed, i.e., after winding shaft 3 has completed a predetermined number of revolutions, and the timing device 103 is tripped, so that the main power circuit feeding drive motor 17 is interrupted and an auxiliary power circuit—which is described in the following in greater detail—is switched on by timing device 103. Said auxiliary power circuit permits drive motor 17 to continue running for a predetermined period of time, for example for 3 or 4 seconds, which suffices to fully retract cloth 4, i.e., the section of said cloth still disposed outside of box 2 when switch 33 is thrown over, so that extendable rod 14 will now come to rest against the slot serving as the passageway for the cloth. Said position is attained even before the current is shut off via the auxiliary power circuit, which, in the subsequent period, causes friction discs 104 and 105 of resilient coupling 20 to rotate against each other because the set of discs 104 connected with winding shaft 3 is retained due to the fact that the extendable rod abuts the slot, whereas the set 105, which is rotatably fixed with hub 35, continues to rotate together with output shaft 19. Clearly, the torque transmitted by friction coupling 20 has to be rated in a way such that drive motor 17 cannot be overloaded; on the other hand, however, said torque has to be sufficient to allow a complete retraction of cloth 4 even under unfavorable operating conditions.

For extending cloth 4 of the awning, the procedure is the same as in the preceding cases, i.e., the power circuit is closed by switch 34 and the motor is started with the corresponding number of revolutions, whereby the power supplied by output shaft 19 is transmitted to winding shaft 3 by friction discs 104 and 105.

Also, friction coupling 20, in association with timing device 103, permits a compensation of the variations in the length of cloth 4, so that the extendable rod always reliably and sealingly rests against slot 6 without overloading drive motor 17.

Figure 15:
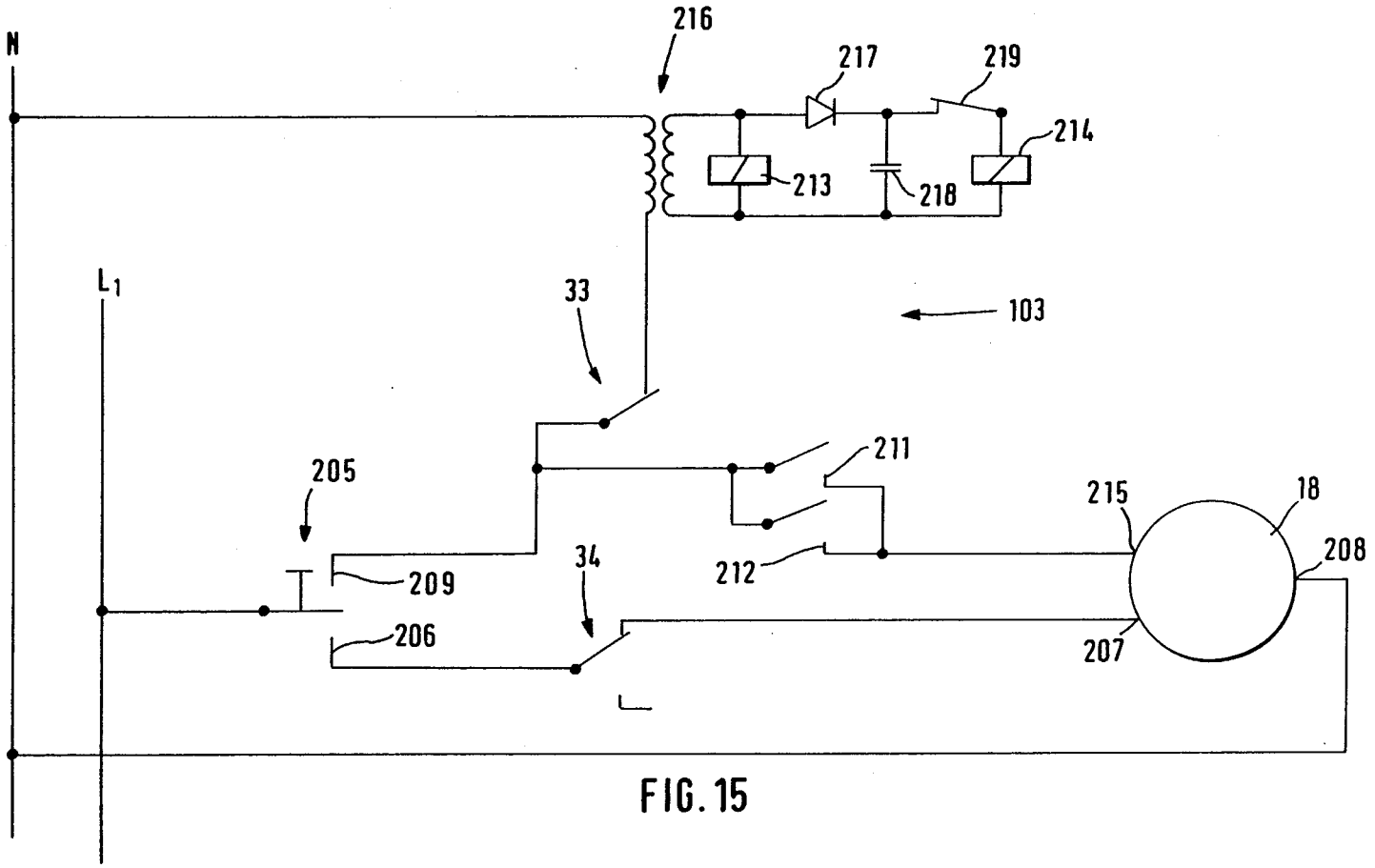
FIG. 15 shows the circuit diagram and wiring of the timing device for the embodiment according to FIG. 13.

FIG. 15 shows the circuit diagram of timing device 103, which is connected to AC mains comprised of a zero conductor identified by 'N' and a phase identified by '$L_1$'. A single-pole selector switch 205 for manual operation is connected with its movable contact to the phase $L_1$, and fixed contact 206 is in contact with the movable contact of limit switch 34. The fixed contact of limit switch 34 leads to connection terminal 207 of drive motor 18, to which terminal the winding of drive motor 18 is connected, said winding carrying current when the cloth of the awning is wound or retracted. The other end of said winding of the motor is connected to the zero conductor N via a connection terminal 208.

The other fixed contact 209 of selector switch 205 abuts both the movable contact of limit switch 33 and the movable contact of two working contacts 211 and 212, which are associated with two relays 213 and 214. The fixed contacts of working contacts 211 and 212 are commonly connected to winding connector 215 corresponding with the direction of start-up rotation of drive motor 18.

A primary winding of a main transformer 216 is connected to the one end of the fixed contact of limit switch 33, and the other end of said winding is connected to the zero conductor. Relay 213 and the series connection comprised of diode 217 and capacitor 218 are connected in parallel to the secondary winding of main transformer 216. Capacitor 218 is connected in parallel with the series connection comprised of relay 214 as well as of an off contact 219, the latter being associated with relay 213.

The switching state shown in FIG. 15 corresponds to a half-way extension of the cloth in which neither of the two limit switches 33 or 34 has responded, so that the cloth of the awning is retracted or extended further depending on the actuation of manual switch 205. The cloth of the awning is extended by throwing said manual switch 205 from the center position shown into the lower position, at which the movable contact is connected to fixed contact 206, so that drive motor 18 is connected to phase $L_1$ of the AC main with its connecting terminal 207 via limit switch 34. As soon as the cloth has been extended into its final position, limit switch 34 opens and the motor current is interrupted. Restarting of the motor with this direction of rotation is impossible because of open limit switch 34. However, if selector switch 205 is shifted into the top position at which fixed contact 209 is connected to the phase $L_1$, current flows via switch 205 and limit switch 33 through the transformer, causing an immediate energizing of relay 213, whereupon the rest or off contact 219 of said relay opens and the associated working contact 211 closes. This results in a flow of current from the AC mains via switch 205 and closed working contact 211 to connecting terminal 215 of drive motor 18, whereupon said motor is started in the sense of a retraction of awning 1.

Simultaneously, via diode 217, capacitor 218 is charged to the peak value of the AC output voltage of transformer 216.

As soon as limit switch 33 responds and opens while the selector switch 205 is still in the top switching position, transformer 216 is no longer supplied with power and relay 213 is de-energized, at which point working contact 211 is opened and resting contact 219 closes. This switches relay 214 to charged capacitor 218, causing said capacitor to respond and close its working contact 212.

In this way, current will now flow from the AC mains via working contact 212 to drive motor 18, causing said motor to run with the sense of rotation conforming to the retraction of cloth 4 until the voltage applied to capacitor 218 has dropped below the holding value of relay 214, which, immediately upon closing of resting contact 219, starts to unload capacitor 218.

Once the holding voltage on capacitor 218 has dropped below the rated value relay 214 will also be de-energized, opening its working contact 212. This will also kill the voltage on connection terminal 215 of drive motor 18, and the motor will be shut off.

By suitably rating the capacity of capacitor 218, which is well known, it is possible to control the time during which drive motor 18 will continue running after limit switch 33 has responded. Drive motor 18, because of open limit switch 33 and simultaneously closed limit switch 34, can be started only in the opposite or reverse direction of rotation. Naturally, drive motor 18 can be shut off also at any time between the two final positions in which one of the two limit switches 33 or 34 responds, namely by switching selector switch 205 into its center position. This does not require any detailed explanation.

Timing device 103 can be used not only in connection with friction coupling 20 as explained based on FIGS. 13 and 14, but also in association with resilient coupling 20 as shown in FIGS. 3 to 12.

In said embodiment, tubular coupling member 26 can be omitted, i.e., the coupling member by means of which output shaft 19 of drive motor 18 is transmittingly connected with drive gear 24 of limit switch arrangement 21. Instead, limit switch arrangement 21 is actuated in dependence on the rotation of winding shaft 3. For this reason, the end of winding shaft 3 on the motor side is provided with plastic ring 101 seated in said end provided with internal gear 102, said ring at the same time forming the bearing of winding shaft 3 at the motor side, as it is shown in the embodiment according to FIGS. 13 and 14. In all other respects, the electrical circuit for limit switch unit 21 and timing device 103 is in conformity with what has been specified in connection with FIGS. 13 to 15.

Figure 16:
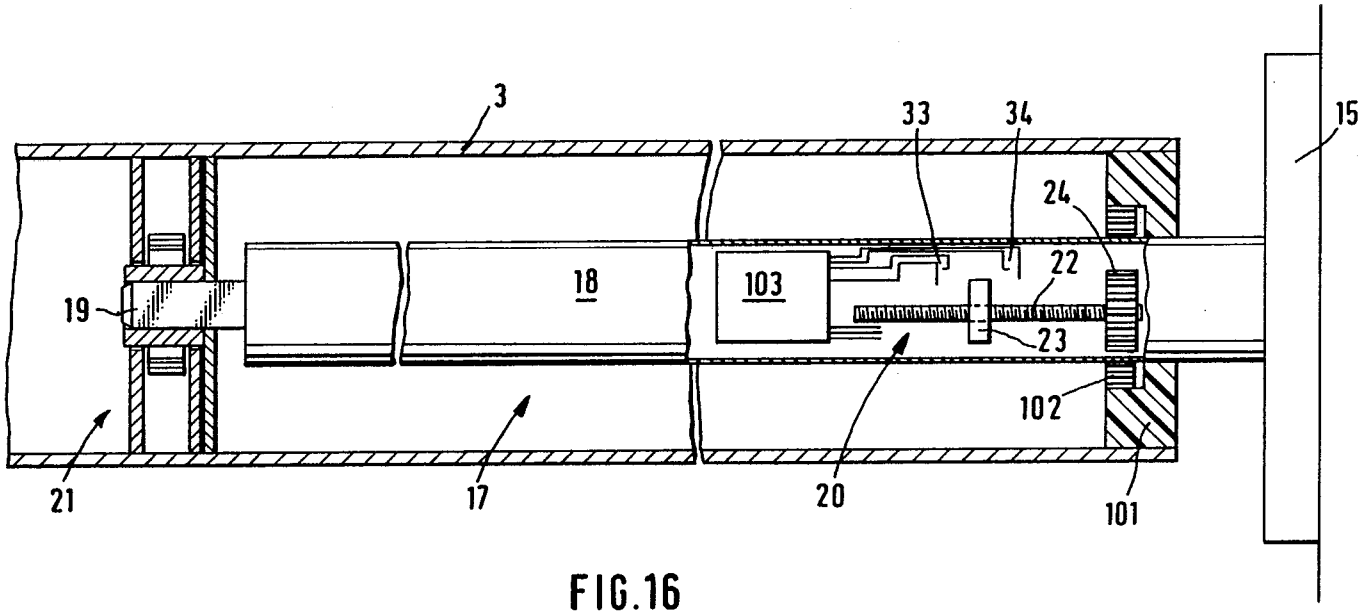
FIG. 16 is a cross sectional view of a winding shaft similar to the one of FIG. 2, with a spring coupling, where the motor is controlled by the timing device.

In the operation of the embodiment according to FIG. 16 the limit switch, which is expected to respond when cloth 4 is in its retracted position, is positioned in a way such that it opens even before extendable rod 14 comes to rest against slot 6 of box 2. As soon as limit switch 33 is actuated during the retraction of awning 1, timing circuit 103 is activated, thereby permitting the drive motor 118 to continue running for a predetermined period of time. Said period of time is such that it is sufficient to allow the retraction of the last piece of cloth 4, so that extendable rod 14 will come to rest against slot 6 of awning box 2. If the time allowed for the after-run of drive motor 18 is dimensioned longer than the time required for causing the extendable rod to come to rest on box 2, resilient coupling 20 is subsequently wound, preventing any overloading of drive motor 18.

Since the after-running time is constant, any change in the length of cloth 4 can be compensated for with the help of resilient coupling 20. Otherwise, such changes in length would require different periods of after-run.

The use of the resilient coupling is explained in connection with the articulated awning shown in the drawings only by way of example; obviously, all embodiments of the resilient coupling may also be used with vertical awnings and awnings fitted with an inclined carriage.

While only a few embodiments of the present invention have been shown and described, it will be obvious that many changes and modifications may be made thereunto without departing from the spirit and scope of the present invention.

What is claimed is:

1. A motorized awning having a rotatably supported winding shaft housed in an awning box for an awning cloth capable of being wound on said winding shaft, said cloth being secured along one edge on the winding shaft and along the opposite edge on an extendable rod, an immovably supported drive motor, its output shaft coupled with the winding shaft for the automatic retraction of the awning, a first limit switch for controlling the motor current when the cloth of the awning is retracted operating in dependence upon the rotary position of the output shaft of the drive motor and being connected directly in the motor power circuit, and a second limit switch for controlling the motor current when the cloth is extended, so that after the actuation of said limit switches the drive motor can be started only with the opposite sense of rotation, the improvement comprising; a resilient coupling member including a spring elastic element positively coupling the output shaft of said motor with the winding shaft at least in the sense of direction of winding of the cloth of the awning, the input side of said coupling member being connected with said output shaft and its output side being connected with said winding shaft, said resilient coupling member permitting at least a limited relative rotary motion between said winding shaft and said output shaft of said drive motor.

2. The awning as defined in claim 1, which further comprises a positive stop means associated with said resilient coupling member for effecting a positive connection between said winding shaft and the output shaft of said motor in the sense of rotation of unwinding of the cloth of the awning.

3. The awning as defined in claim 1, wherein said resilient coupling member is connected by positive engaging means with said winding shaft and the output shaft of said motor on the output and input sides of said coupling member, respectively.

4. The awning as defined in claim 1, wherein said winding shaft is in the form of a tube having a beading projecting radially inwardly and extending along the length of said winding shaft, said winding shaft containing in its interior said resilient coupling member and said drive motor, the output side of said coupling member lockingly engaging said beading.

5. The awning as defined in claim 1, wherein said resilient coupling member includes a hub forming the input side thereof, a driver rotatably supported and axially secured on said hub, said driver having at least one recess on the peripheral edge thereof, and said spring elastic element interconnecting between said hub and said driver.

6. The awning as defined in claim 5, wherein said spring elastic element is a leaf spring wound several times around said hub, said spring being anchored at its one end on said hub and at its other end on said driver.

7. The awning as defined in claim 5, wherein said resilient coupling member includes as drivers two identical circular disks arranged parallel to each other with a space therebetween, said disks being rigidly interconnected and rotatably arranged on said hub, and said spring elastic element being disposed between said two disks.

8. The awning as defined in claim 5, wherein said spring elastic element is a coil spring anchored at one end on said hub and at its other end on said driver, said driver being rotatably supported on said hub.

9. The awning as defined in claim 8, wherein said coil spring is coaxially arranged around said hub.

10. The awning as defined in claim 8, wherein said coil spring extends in the circumferential direction of said hub and arches with its axis around the circumferential surface of said hub.

11. The awning as defined in claim 5, which further comprises a positive stop means associated with said resilient coupling member for effecting a positive connection between said winding shaft and the output shaft of said motor in the sense of rotation of unwinding of the cloth of the awning.

12. The awning as defined in claim 11, wherein said positive stop means comprises a segmented disk rotatably fixed on said hub and extending parallel to the driver rotatably supported on said hub and defining a sector angle complementary to the rotary motion of 360°.

13. The awning as defined in claim 1, wherein said resilient coupling member is a torsion bar extending coaxially with said winding shaft.

14. The awning as defined in claim 13, wherein said torsion bar at a first end is provided with a coupling device for receiving the output shaft of said motor and supports at a second end a driver, said driver being rotatably fixed with respect to said torsion bar and coupled with said winding shaft.

15. The awning as defined in claim 4, wherein said output side of said coupling member includes a driver having a recess on the peripheral edge thereof which lockingly engages the beading of said winding shaft.

16. The awning as defined in claim 12, wherein said resilient coupling member is a torsion bar extending coaxially with said winding shaft.

17. The awning as defined in claim 16, wherein said segmented disk is rotatably fixed to an end of said torsion bar coupled with said output shaft.

18. The awning as defined in claim 12, wherein said resilient coupling member is completely accommodated in said winding shaft, said winding shaft being in the form of a tube having a beading projecting radially inwardly and extending along the length thereof, the recess of said driver engaging with said beading, and said segmented disk being adapted to engage with the beading of said winding shaft for engaging said hub with said winding shaft.

19. The awning as defined in claim 1, wherein said coupling member is comprised of two sets of alternatingly arranged friction discs spring biased against each other, one of said sets being rotatably fixed and axially displaceable on a hub coupled to the output shaft of said motor, and the other set being rotatably fixed and axially displaceable with respect to said winding shaft.

20. The awning as defined in claim 1, wherein said coupling member is seated in said winding shaft.

21. A motorized awning having a rotatably supported winding shaft housed in an awning box for an awning cloth capable of being wound on said winding shaft, said cloth being secured along one edge on the winding shaft and along the opposite edge on an extendable rod, an immovably supported drive motor, its output shaft coupled with the winding shaft for the automatic retraction of the awning, a first limit switch for controlling the motor current when the cloth of the awning is retracted operating in dependency upon the rotary position of the winding shaft and connected to a timing device in the motor power circuit so that on actuation of this first limit switch the drive motor continues to run for a predetermined period of time in the sense of further winding of the cloth of the awning, and a second limit switch for controlling the motor current when the cloth is extended, so that after the actuation of said limit switches the drive motor can be started only with the opposite sense of rotation, the improvement comprising; a resilient coupling member including a spring elastic element positively coupling the output shaft of said motor with the winding shaft at least in the sense of direction of winding of the cloth of the awning, the input side of said coupling member being connected with said output shaft and its output side being connected with said winding shaft, said resilient coupling member permitting at least a limited relative rotary motion between said winding shaft and said output shaft of said drive motor.

22. The awning as defined in claim 21, which further comprises a positive stop means associated with said resilient coupling member for effecting a positive connection between said winding shaft and the output shaft of said motor in the sense of rotation of unwinding of the cloth of the awning.

23. The awning as defined in claim 21, wherein said resilient coupling member is connected by positive engaging means with said winding shaft and the output shaft of said motor on the output and input sides of said coupling member, respectively.

24. The awning as defined in claim 21, wherein said winding shaft is in the form of a tube having a beading projecting radially inwardly and extending along the length of said winding shaft, said winding shaft containing in its interior said resilient coupling member and said drive motor, the output side of said coupling member lockingly engaging said beading.

25. The awning as defined in claim 21, wherein said resilient coupling member includes a hub forming the input side thereof, a driver rotatably supported and axially secured on said hub, said driver having at least one recess on the peripheral edge thereof, and said spring elastic element interconnecting between said hub and said driver.

26. The awning as defined in claim 25, wherein said spring elastic element is a leaf spring wound several times around said hub, said spring being anchored at its one end on said hub and at its other end on said driver.

27. The awning as defined in claim 25, wherein said resilient coupling member includes as drivers two identical circular disks arranged parallel to each other with a space therebetween, said disks being rigidly interconnected and rotatably arranged on said hub, and said spring elastic element being disposed between said two disks.

28. The awning as defined in claim 25, wherein said spring elastic element is a coil spring anchored at one end on said hub and at its other end on said driver, said driver being rotatably supported on said hub.

29. The awning as defined in claim 28, wherein said coil spring is coaxially arranged around said hub.

30. The awning as defined in claim 28, wherein said coil spring extends in the circumferential direction of said hub and arches with its axis around the circumferential surface of said hub.

31. The awning as defined in claim 25, which further comprises a positive stop means associated with said resilient coupling member for effecting a positive connection between said winding shaft and the output shaft of said motor in the sense of rotation of unwinding of the cloth of the awning.

32. The awning as defined in claim 31, wherein said positive stop means comprises a segmented disk rotatably fixed on said hub and extending parallel to the driver rotatably supported on said hub and defining a sector angle complementary to the rotary motion of 360°.

33. The awning as defined in claim 21, wherein said resilient coupling member is a torsion bar extending coaxially with said winding shaft.

34. The awning as defined in claim 33, wherein said torsion bar at a first end is provided with a coupling device for receiving the output shaft of said motor and supports at a second end a driver, said driver being rotatably fixed with respect to said torsion bar and coupled with said winding shaft.

35. A motorized awning having a rotatably supported winding shaft housed in an awning box for an awning cloth capable of being wound on said winding shaft, said cloth being secured along one edge on the winding shaft and along the opposite edge on an extendable rod, an immovably supported drive motor, its output shaft coupled with the winding shaft for the automatic retraction of the awning, a first limit switch for controlling the motor current when the cloth of the awning is retracted operating in dependency upon the rotary position of the winding shaft and connected to a timing device in the motor power circuit so that on activation of this first limit switch the drive motor continues to run for a predetermined period of time in the sense of further winding of the cloth of the awning, and a second limit switch for controlling the motor current when the cloth is extended, so that after the actuation of said limit switches the drive motor can be started only with the opposite sense of rotation, the improvement comprising; a resilient coupling member in the form of friction means coupling the output shaft of said motor to said winding shaft, the input side of said coupling member being connected with said output shaft and its output side being connected with said winding shaft, said resilient coupling member permitting at least a limited relative rotary motion between said winding shaft and said output shaft of said drive motor.

36. The awning as defined in claim 35, which further comprises a positive stop means associated with said resilient coupling member for effecting a positive connection between said winding shaft and the output shaft of said motor in the sense of rotation of unwinding of the cloth of the awning.

37. The awning as defined in claim 35, wherein said resilient coupling member is connected by positive engaging means with said winding shaft and the output shaft of said motor on the output and input sides of said coupling member, respectively.

38. The awning as defined in claim 35, wherein said winding shaft is in the form of a tube having a beading projecting radially inwardly and extending along the length of said winding shaft, said winding shaft containing in its interior said resilient coupling member and said drive motor, the output side of said coupling member lockingly engaging said beading.

* * * * *